US011117782B2

(12) United States Patent
Lovric

(10) Patent No.: US 11,117,782 B2
(45) Date of Patent: Sep. 14, 2021

(54) FORCE ADJUSTING BRAKING DEVICE FOR AN ELEVATOR SYSTEM

(71) Applicant: TK Elevator Innovation and Operations GmbH, Essen (DE)

(72) Inventor: Markan Lovric, Stuttgart (DE)

(73) Assignee: TK Elevator Innovation and Operations GmbH, Essen (DE)

( * ) Notice: Subject to any disclaimer, the term of this patent is extended or adjusted under 35 U.S.C. 154(b) by 100 days.

(21) Appl. No.: 16/333,683

(22) PCT Filed: Sep. 11, 2017

(86) PCT No.: PCT/EP2017/072681
§ 371 (c)(1),
(2) Date: Mar. 15, 2019

(87) PCT Pub. No.: WO2018/050577
PCT Pub. Date: Mar. 22, 2018

(65) Prior Publication Data

US 2019/0256321 A1 Aug. 22, 2019

(30) Foreign Application Priority Data

Sep. 16, 2016 (DE) ..... 10 2016 217 790.7

(51) Int. Cl.
*B66B 1/44* (2006.01)
*B66B 1/32* (2006.01)
(Continued)

(52) U.S. Cl.
CPC ..... *B66B 1/32* (2013.01); *B66B 1/3476* (2013.01); *B66B 1/50* (2013.01); *B66B 5/18* (2013.01); *B66B 2009/006* (2013.01)

(58) Field of Classification Search
CPC ..... B66B 1/44; B66B 1/32; B66B 1/3484
(Continued)

(56) References Cited

U.S. PATENT DOCUMENTS 4,793,442 A * 12/1988 Heckler ..... B66B 1/28 187/292
5,193,651 A * 3/1993 Shigeta ..... B66B 7/046 187/409
(Continued)

FOREIGN PATENT DOCUMENTS

CN 2048062 U 11/1989
CN 102275795 A 12/2011
(Continued)

OTHER PUBLICATIONS

English Translation of International Search Report issued in PCT/EP2017/072681, dated Nov. 23, 2017.

*Primary Examiner* — Christopher Uhlir
(74) *Attorney, Agent, or Firm* — William J Cassin

(57) ABSTRACT

A braking device may be utilized by an elevator system that has a cabin that is movable within an elevator shaft. The braking device may comprise an actuator and a brake. The actuator may be configured to provide an actuating force for the brake as needed. The braking device may include a force measuring assembly for generating a load state value of the cabin. The force measuring assembly may be mechanically coupled to the actuator such that the actuating force is dependent on the load state value. The actuator may be configured such that the greater the load state value the greater the actuating force.

20 Claims, 2 Drawing Sheets

(51) Int. Cl.

| | |
|---|---|
| ***B66B 1/34*** | (2006.01) |
| ***B66B 1/50*** | (2006.01) |
| ***B66B 5/18*** | (2006.01) |
| *B66B 9/00* | (2006.01) |

(58) Field of Classification Search
USPC ..... 187/254
See application file for complete search history.

(56) References Cited

U.S. PATENT DOCUMENTS

| | | | | |
|---|---|---|---|---|
| 5,265,701 | A * | 11/1993 | Ogasawara | B66B 5/18 187/254 |
| 6,425,462 | B1 | 7/2002 | Tran | |
| 2014/0158476 | A1* | 6/2014 | Wei | B66B 5/22 188/65.1 |

FOREIGN PATENT DOCUMENTS

| | | | |
|---|---|---|---|
| EP | 1657203 | A | 5/2006 |
| EP | 1840068 | A | 10/2007 |
| JP | H0459579 | A | 2/1992 |
| JP | 2012158440 | A | 8/2012 |
| WO | 2015150285 | A | 10/2015 |
| WO | 2016071141 | A | 5/2016 |

* cited by examiner

FORCE ADJUSTING BRAKING DEVICE FOR AN ELEVATOR SYSTEM

CROSS REFERENCE TO RELATED APPLICATIONS

This application is a U.S. National Stage Entry of International Patent Application Serial Number PCT/EP2017/072681, filed Sep. 11, 2017, which claims priority to German Patent Application No. DE 10 2016 217 790.7, filed Sep. 16, 2016, the entire contents of both of which are incorporated herein by reference.

FIELD

The present disclosure generally relates to elevator systems, braking devices, braking devices for elevator systems, and methods for setting an actuating force of braking devices.

BACKGROUND

With conventional traction elevators the cabin is prevented from crashing, for example the traction rope breaking, by a catching device. In most cases the braking force of the catching device is set to be the mean payload of the elevator system. It is only when the cabin load is equal to the mean payload, that an optimal delay of the cabin results. If the payload is higher than the mean payload, the catching device delays the cabin less, which leads to the braking distance becoming longer. If the payload is less than the mean payload, the catching device delays the cabin faster and the load on components of the cabin increases. This can lead to damage of the elevator system and the danger of injury to the passengers increases.

WO 2016 071141 A1 discloses an elevator with a braking device. The braking device is designed to be used, on the one hand, as an operating brake, and on the other, as a catching device. The braking force available differs according to the intended use.

EP 1 657 203 A2 has disclosed a catching device for an elevator. The braking force progression is arranged such, that the maximum braking force acting on the cabin is higher for a fully loaded cabin than for a partially loaded cabin. This is achieved by causing the braking force to increase in a ramp-like fashion. If the cabin is not fully loaded, the cabin comes to a standstill, before the maximum braking force has been completely reached. This means however, if the argument is reversed, that for a fully loaded cabin the maximum braking force acts on the cabin at a comparatively late stage, so that the braking distance for a fully loaded cabin is comparatively large.

Thus a need exists to improve braking systems for elevator systems to ensure that the delay of the cabin and the braking distance are optimal in all load states.

DETAILED DESCRIPTION

Figure 1:
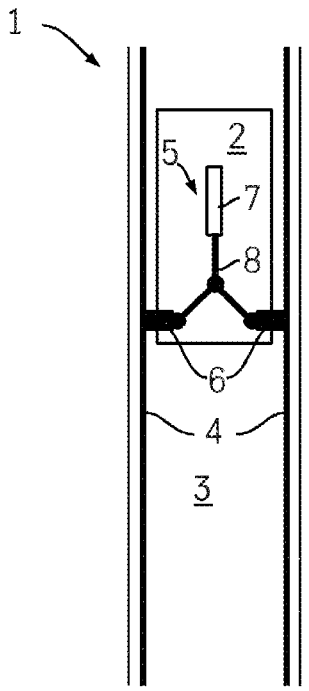
FIG. 1 is a schematic view of an example elevator system comprising an example braking device.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The advantages and design options described for the example braking devices and the example elevator systems are applicable without further ado to the method and vice-versa.

The braking device according to the invention is suitable for an elevator system, which comprises a movable cabin inside an elevator shaft. The braking device comprises an actuator and a brake. The actuator is configured to provide an actuating force for the brake when needed. The braking device comprises a force measuring assembly for producing a load state value of the cabin. The force measuring assembly is mechanically coupled to the actuator such that the actuating force is dependent on the load state value.

The term mechanical coupling comprises expressly a fluid-mechanical coupling, for example by means of a hydraulic or pneumatic line. Alternatively or in combination hoists or levers can be used as a mechanical coupling. The load state value may basically be a value, which largely correctly reflects the load on the cabin in a static state. Falsifying dynamic measuring influences, if any, can be filtered.

The actuating device according to the invention makes it possible for the actuating force to be optimally matched to the load. The greater the load or the load state value, the greater the actuating force may be. This makes it possible in any load state for the braking distance and/or the delay to assume a desired value when needed. There is no longer any need for an expensive electronic control of the actuating force, which takes account of the load state. In particular, the braking device therefore does not comprise an electronic control for the actuating force which takes account of the load state.

Preferably the force measuring assembly comprises at least one, in particular at least three, load cells, which are configured to together detect a weight force of the cabin. The weight force or weight forces detected do not need to be the total of all weight forces of the cabin. Rather it may suffice to arrange the load cells underneath the cabin floor, for example, so that parts of the floor can be detected including the load acting on them. The force measuring assembly is configured to generate the load state value from the detected weight force (including any plurality of weight forces detected).

Preferably the force measuring assembly comprises a low pass filter, which is arranged to filter dynamic influences of a primary value of the load state value. The load state values detected by the at least one load cell can be falsified by accelerations of the cabin. Influences due to these dynamic effects can be at least reduced by using the filter.

Preferably the braking device comprises a stop for limiting the influence of the load state value on the actuating force. In this way it is possible to limit the influence from extreme, in particular unrealistic load state values. Such extreme load state values can be caused by defects or extreme dynamic influences.

Preferably the actuator comprises a force capacity for providing the actuating force. The actuator is configured so as to set a preload for the force capacity as a function of the load state value. The greater the preload, the greater is also at least the initial actuating force.

Preferably the actuator is designed such that, when in a standby mode, the force capacity is held against the actuating force in a standby position in which no actuating force is applied to the brake, and when in actuating mode, the force capacity is not held in the standby position and the actuating force is applied to the brake.

Preferably the force measuring assembly is arranged to pass the load state value onto the actuator by means of a pressurized fluid, with the actuator being arranged in particular such that the fluid preloads the force memory or at least increases a preload.

The method according to the invention comprises the following method steps: generating a load state value of the cabin by way of the force measuring assembly, communicating the load state value from the force measuring assembly via a mechanical coupling to the actuator, setting the actuating force as a function of the communicated load state value.

The invention is suitable, in particular, for applications with braking devices in the form of catching devices. Essentially, with such catching devices an at least temporarily pre-set actuating force is fully retrieved when needed. The present invention makes it possible to adjust the amount of actuating force to be fully retrieved to match the load state.

FIG. 1 shows an elevator system 1 according to the invention, which comprises a cabin 2 which is received within an elevator shaft 3. The cabin 2 is held vertically movably in guide rails 4 by means of guide rollers not shown. The elevator system 1 further comprises a braking device 5 with at least one brake 6. In case of a defect one or more such brakes 6 can be activated. The braking device 5 comprises an actuator 7 which provides a braking force when needed. The braking force is transferred to the brakes 6 via a connector 8.

Figure 2:
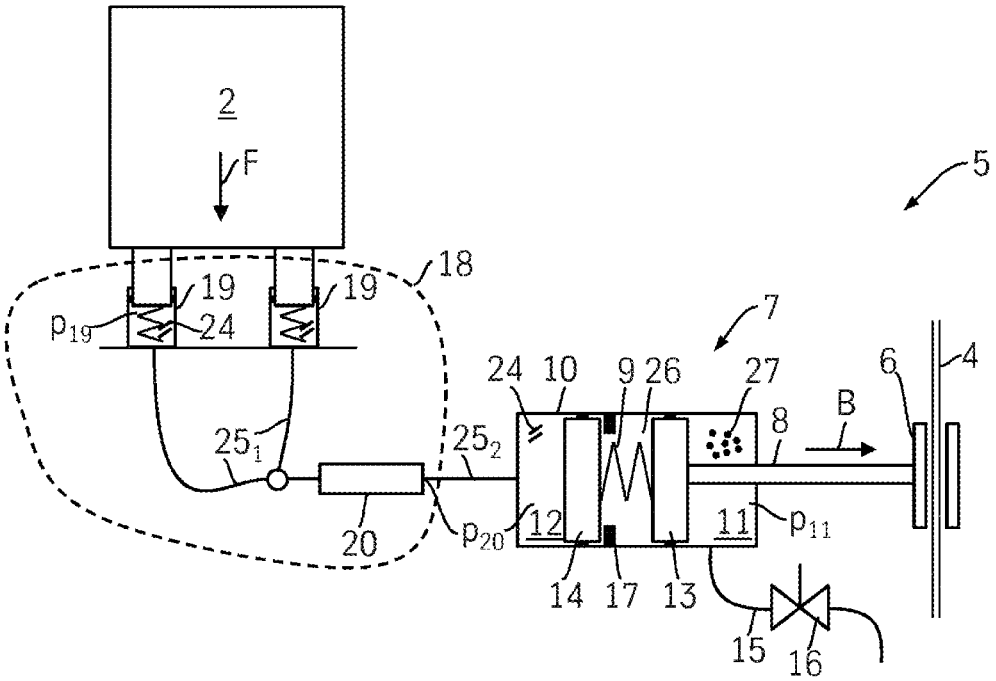
FIG. 2 is a schematic view of components of the example braking device in FIG. 1.

FIG. 2 shows the braking device 5 in more detail. The braking device accordingly comprises three essential components, i.e. the brake 6, the actuator 7 and a force measuring assembly 18.

The brake 6 when actuated starts to interact with the guide rail 4 in order to thereby at least reduce the speed of the cabin 2, in particular to bring the cabin to a standstill. The actuator 7 actuates the brake 6. In doing so the actuator 7 generates an actuating force B when needed, as a result of which the brake 6 starts to interact with the rail 4.

In the present example the actuator comprises an actuating cylinder 10, in which a first working piston 13 is arranged. On the one hand this first working piston 13 is impacted by a spring 9, which is dimensioned so as to apply the actuating force B. On the other hand the first working piston 13 is held back by a pneumatic medium 27 (e.g. air) present in a first working chamber 11 at a pneumatic pressure $p_{11}$ in a standby state. The pneumatic pressure $p_{11}$ counteracts the spring 9, so that the actuator cannot apply the actuating force B to the brake 6. When needed a vent valve 16 is opened and the pneumatic pressure $p_{11}$ can escape from the first working chamber 11. The actuating force B which can be generated by the force capacity 9, can now be transferred via the connector 8 to the brake 6. A clearance 26 between the two working pistons 13, 14 can be impacted by environmental pressure.

The force capacity 9 is preloaded by a second working piston 14, which is also arranged in the actuating cylinder. Counteracting the spring 9 is a second working chamber 12 arranged on the other side of the second working piston 14, and this working chamber 12 contains a hydraulic oil 24. The hydraulic oil 24 is pressurized by load cells 19, which are connected via a hydraulic connection 25 to the second working chamber 12. The load cells are arranged below the cabin 2 and are impacted according to the load of the cabin 2 including the cabin content. Depending on the weight of the cabin a primary pressure $p_{19}$ is generated by the load cells 19, which equally represents an unfiltered hydraulic pressure value. Preferably at least three load cells 19 are provided for support the cabin floor without tilting.

Figure 3:
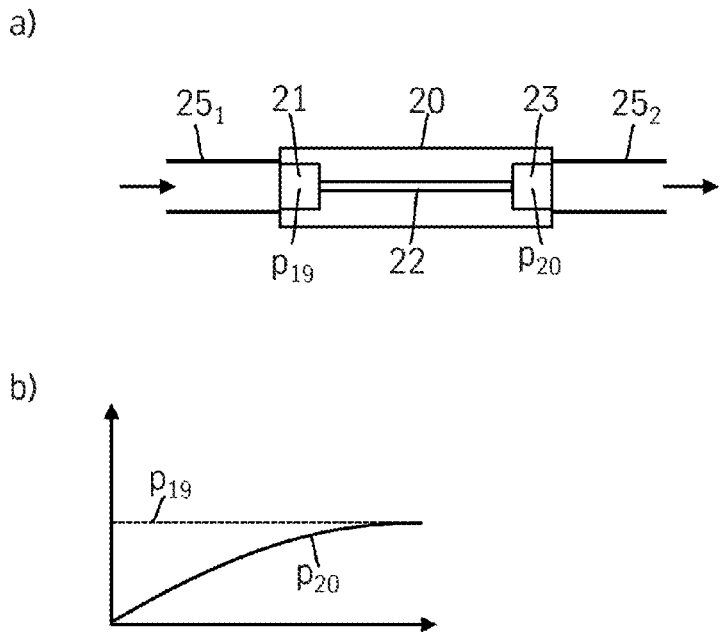
FIG. 3*a* is a schematic view of an example throttle unit of the braking device of FIG. 2.
FIG. 3*b* is a step response diagram associated with the example throttle unit of FIG. 3*a*.

A low pass filter 20, here in the form of a throttle, is arranged in the hydraulic connection 25 between the load cells 19 and the second working chamber 12. An example of a throttle is shown in detail in FIG. 3*a*, and the associated step response diagram is shown in FIG. 3*b*. The low pass filter 20 comprises an inlet 21, which is connected via a first line 251 to the load cell 19. At the inlet 21 the hydraulic primary pressure $p_{19}$ is present, which is provided by the load cells 19. The inlet 21 is connected to an outlet 23 via a throttle point 22 with reduced line cross-section, which in turn is connected via a second line 252 to the second working chamber 12. The secondary pressure $p_{20}$ present at the outlet 23 which simultaneously represents a filtered hydraulic pressure value, is also present in the second working chamber 12 and has a major impact on the preload force for the spring 9. The second line 252 represents the coupling between the force measuring assembly 18 and the actuator 7.

Figure 4:
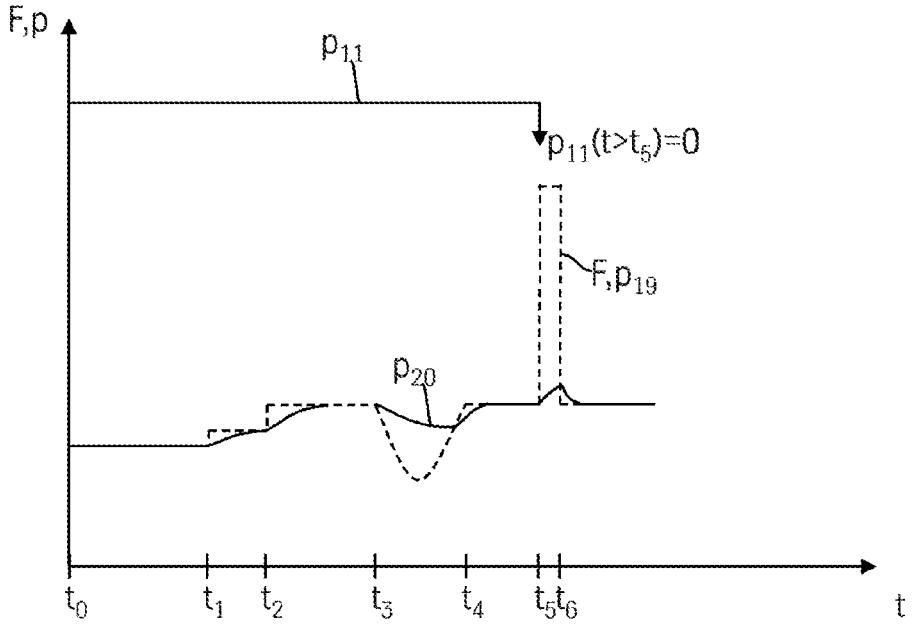
FIG. 4 is a schematic view depicting progression of selected pressure and force values during operation.

The importance of the low pass filter 20 is explained by way of the diagram in FIG. 4. The diagram shows the progression of the primary pressure $p_{19}$ and the secondary pressure $p_{20}$. The progression of the secondary pressure $p_{20}$ is shown by a continuous line. At the point where the progression of the primary pressure $p_{19}$ is different from the progression of the secondary pressure $p_{20}$, the diagram shows the progression of the primary pressure $p_{19}$ in the form of a dotted line. The progression of the primary pressure $p_{19}$ is essentially identical to a cabin load F, which impacts the load cells 19 from above. In addition the pneumatic pressure $p_{11}$ in the first working chamber 11 is shown at the top.

At the point in time $t_0$ the cabin 2 is stationary on one floor. The doors open. At the point in time $t_1$ a first person boards, at the point in time $t_2$ a second person boards. Boarding of the persons is depicted by a step each in the progression of the primary pressure $p_{19}$. Due to the inertia of the filter 20 the progression of the secondary pressure $p_{20}$ is delayed in terms of time. The doors close and the cabin 2 moves downwards. Due to the downward acceleration the load on the load cells 19 is reduced, the primary pressure $p_{19}$ drops temporarily. Again the progression of the secondary pressure $p_{20}$ is delayed in terms of time. As from point in time t4 the cabin 2 descends at a constant speed.

At the point in time $t_5$ emergency braking is initiated by opening of the valve 16, with no pneumatic pressure $p_{11}$ present. Immediately afterwards the brake 6 is activated and braking of the cabin 2 is complete as soon as point in time $t_6$ is reached. Due to massive acceleration during the braking operation primary pressure $p_{19}$ temporarily rises. Due to the progression of the primary pressure $p_{19}$ it can be seen that the dynamic primary pressure $p_{19}$ is not sufficiently representative of the load state of the cabin.

Although the secondary pressure $p_{20}$ follows the progression of the primary pressure $p_{19}$, the progression is substantially attenuated. In particular during the braking operation in the period between $t_5$ and $t_6$ the secondary pressure $p_{20}$ represents a value, which maps the actual load state substantially better than the primary pressure $p_{19}$. Due to a suitable selection of the filter parameters the progression of the secondary pressure $p_{20}$ can be optimized during the braking operation.

LIST OF REFERENCE SYMBOLS

1 elevator system
2 cabin
3 elevator shaft
4 guide rails
5 braking device
6 brake
7 actuator
8 connector
9 preload spring
10 actuating cylinder
11 first working chamber (pneumatic chamber)
12 second working chamber (hydraulic chamber)
13 first working piston
14 second working piston
15 vent line
16 vent valve
17 stop
18 force measuring assembly
19 load cell
20 throttle unit
21 inlet
22 throttle piece
23 outlet
24 hydraulic oil
25 hydraulic line
26 clearance
27 pneumatic medium
$P_{19}$ unfiltered hydraulic pressure value
$p_{20}$ filtered hydraulic pressure value
$P_{11}$ pneumatic pressure valve
F cabin load
B actuating force

What is claimed is:

1. A braking device for an elevator system having a cabin that is movable inside an elevator shaft, the braking device comprising:

a brake configured to be brought into engagement with a guide rail of the elevator system to brake the cabin relative to the guide rail;

an actuator having disposed therein a first piston connected to the brake, a second piston, and a spring disposed between and in contact at opposing ends with each of the first and second pistons, which spring is configured to be preloaded and to apply an actuating force to the first piston to drive the brake into braking engagement with the guide rail; and a force measuring assembly mechanically coupled to the second piston of the actuator, the force measuring assembly being configured to generate a load state value corresponding to a force load state of the cabin, and to displace the second piston relative to the first piston in order to adjust both of the amount of preload in the spring and the amount of actuating force to be applied from the spring through the first piston to the brake, depending on the load state value.

2. The braking device of claim 1, wherein the actuator is configured such that the greater the load state value, the greater the actuating force.

3. The braking device of claim 1, wherein the force measuring assembly comprises a load cell configured to detect a weight force of the cabin, wherein the force measuring assembly is configured to generate the load state value from the weight force.

4. The braking device of claim 1, wherein the force measuring assembly comprises at least three load cells configured to detect a weight force of the cabin, wherein the force measuring assembly is configured to generate the load state value from the weight force.

5. The braking device of claim 1, wherein the force measuring assembly comprises a low pass filter configured to filter dynamic influences out of a primary value of the load state value.

6. The braking device of claim 1, further comprising a stop configured to limit an influence of the load state value on the actuating force.

7. The braking device of claim 1, wherein the actuator is configured such that when it is in a standby mode, the spring is held in a standby position and prevented from applying the actuating force to the brake, and wherein when the actuator is in an operating mode, the spring is released from the standby position and the actuating force provided by the spring is applied to the brake.

8. The braking device of claim 1, wherein the force measuring assembly is configured to transmit the load state value of the cabin to the actuator by way of a pressurized fluid.

9. The braking device of claim 8, wherein the actuator is configured such that the pressurized fluid preloads the spring or increases an amount of preload in the spring.

10. An elevator system comprising:

a cabin that is movable along a guide rail inside an elevator shaft; and a braking device comprising, a brake configured to be brought into engagement with the guide rail to brake the elevator cabin relative to the guide rail, an actuator having disposed therein a first piston connected to the brake, a second piston, and a spring disposed between and in contact at opposing ends with each of the first and second pistons, which spring is configured to be preloaded and to apply an actuating force to the first piston to drive the brake into braking engagement with the guide rail, and a force measuring assembly mechanically coupled to the second piston of the actuator, the force measuring assembly being configured to generate a load state value corresponding to a force load state of the cabin, and to displace the second piston relative to the first piston in order to adjust both of the amount of preload in the spring and the amount of actuating force to be applied from the spring through the first piston to the brake, depending on the load state value.

11. The elevator system of claim 10, wherein the actuator is configured such that the greater the load state value, the greater the actuating force.

12. The elevator system of claim 10, wherein the force measuring assembly comprises a load cell configured to detect a weight force of the cabin, wherein the force measuring assembly is configured to generate the load state value from the weight force.

13. The elevator system of claim 10, wherein the force measuring assembly comprises at least three load cells configured to detect a weight force of the cabin, wherein the force measuring assembly is configured to generate the load state value from the weight force.

14. The elevator system of claim 10, wherein the force measuring assembly comprises a low pass filter configured to filter dynamic influences out of a primary value of the load state value.

15. The elevator system of claim 10, further comprising a stop configured to limit an influence of the load state value on the actuating force.

16. The elevator system of claim 10, wherein the actuator is configured such that when it is in a standby mode, the spring is held in a standby position and prevented from applying the actuating force to the brake, and wherein when the actuator is in an operating mode, the spring is released from the standby position and the actuating force provided by the spring is applied to the brake.

17. The elevator system of claim 10, wherein the force measuring assembly is configured to transmit the load state value of the cabin to the actuator by way of a pressurized fluid.

18. The braking device of claim 1, wherein the first piston is arranged in a first working chamber, wherein the first working chamber is configured to apply a pressure to the first piston for counteracting the preload of the spring applied to the first piston, and wherein the first working chamber is configured to release the pressure for applying the actuation force provided by the spring to the brake.

19. The braking device of claim 1, wherein the first piston and the second piston are arranged in a same actuating cylinder, wherein the actuating cylinder comprises a first working chamber where the first piston is arranged, and a second working chamber where the second piston is arranged, wherein the first working chamber and the second working chamber are provided at opposing sides of the spring.

20. The elevator system of claim 10, wherein the first piston is arranged in a first working chamber, wherein the first working chamber is configured to apply a pressure to the first piston for counteracting the preload of the spring applied to the first piston, and wherein the first working chamber is configured to release the pressure for applying the actuation force provided by the spring to the brake.

* * * * *